US005443405A

United States Patent [19]

Zeyger

[11] Patent Number: 5,443,405

[45] Date of Patent: Aug. 22, 1995

[54] BIKE BOARD

[76] Inventor: Yevgeniy Zeyger, 835 Huntington Ave. #608, Boston, Mass. 02115

[21] Appl. No.: 217,557

[22] Filed: Mar. 25, 1994

[51] Int. Cl.[6] ..... B63H 21/175

[52] U.S. Cl. ..... 440/12; 440/30

[58] Field of Search ..... 440/11, 12, 21, 26, 440/27, 30, 31; 441/74; 114/39.2, 61, 162, 123, 144 R

[56] References Cited

U.S. PATENT DOCUMENTS

| | | | |
|---|---|---|---|
| 4,092,945 | 6/1978 | Ankeri et al. | 115/2 |
| 4,511,338 | 4/1985 | Fanelli | 440/26 |
| 4,559,892 | 12/1985 | Cascallana | 114/270 |
| 4,789,365 | 12/1988 | Jones | 440/21 |
| 4,795,381 | 1/1989 | Willems | 440/26 |
| 4,819,575 | 4/1989 | Dixon | 114/270 |

*Primary Examiner*—Stephen P. Avila

[57] ABSTRACT

The bike-board for moving over the water on a conventional said board (10), so that movement is carried out with the help of a conventional bicycle (12), installed on the board. The stability of the bike-board is ensured by two side pontoons (34) with a beams (36 and 38) but the bicycle (12) is fixed by side straps (26). The bike-board is provided with a propellers (48) are kinematically connected to a supporting rollers (14 and 16) with the tire of the bicycle (12) rear wheel. The propellers (48) are rotated by flexible shafts (50). For steering the propellers (48) are made turning and are provided with pivot shafts (52). Turning of the propellers (48) is carried out by the front wheel with the help of a steering cable (56). The design of the bike-board so that any model of the board (10) can be joined with any model of the bicycle (12) regardless of its size and wheelbase; without any modification of both the board (10) and the bicycle (12). To achieve this the supporting rollers (14 and 16) are mounted on a common frame (18) is combined with the rear beam (38). This module mounted on the upper surface of the board and is pressed with the help of straps (24 and 44) surrounded the board from below. The front wheel is mounted on a turning support (28) analogous of a mastfoot of a windsurf. It can be inserted at any position on the mast track of the board corresponded to the wheelbase of the bicycle.

1 Claim, 3 Drawing Sheets

BIKE BOARD

BACKGROUND-CROSS-REFERENCES TO RELATED APPLICATION

Figure 1:
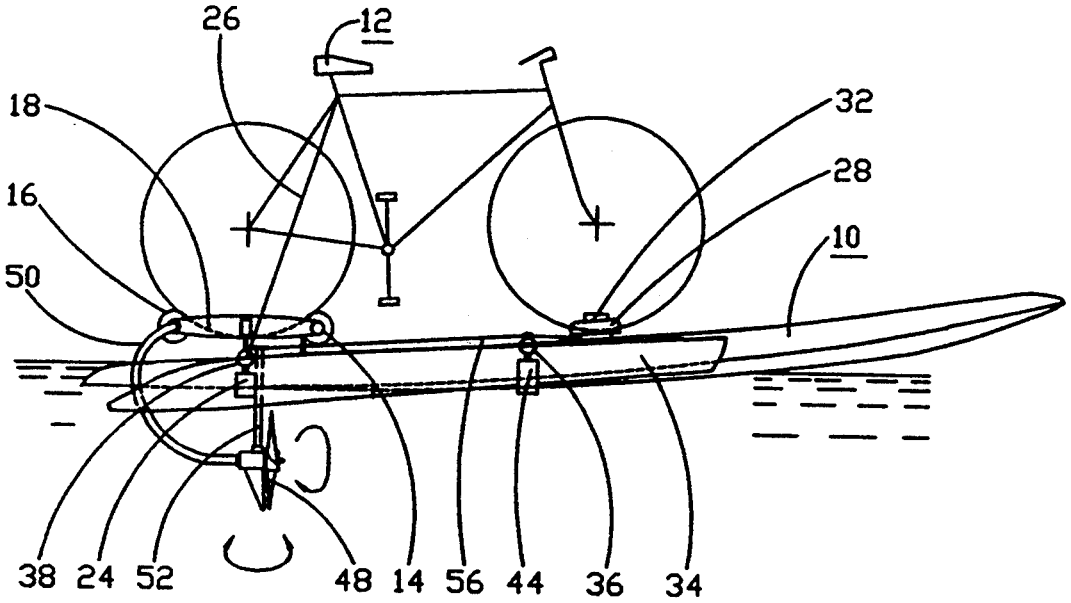

This invention uses the Abstract and Drawings of my "Bike-surf" PTO Disclosure Document No. 340602, Filed 1993, Oct. 8.

1. Background-Field of Invention

This invention relates to devices and apparatuses for water sporting, recreational, tourism and more particularly for devices and apparatuses including propelling means and steering means actuated by the bicycle, motorbike, etc.

2. Background-Discussion of Prior Act

This invention is propose to use a conventional bicycle for movement over the water.

It is known watercycling sport devices comprising a floating body, a seat carried by the floating body for a person, a treadle mechanism driveable by the person and propulsion means coupled to the treadle mechanism. All this designed as special components. Examps of such art can be found with reference to U.S. Pat. No. 4,795,381 to Willems (1989).

It is also known structures for movement over the water with the help of the special designed bicycle is installed on the conventional floatation member, for example sailboard without any modification of the conventional sailboard. Examps of such art can be found with reference to U.S. Pat. No. 4,511,338 to Fanelli (1985).

It is also known structures for movement over the water with the help of the bicycle without any modification of the conventional bicycle. At this point however, require the manufacture of a special floating body with a motion-steering complex and a support framework for supporting a bicycle. Examps of such art can be found with reference to U.S. Pat. No. 4,789,365 to Jones (1988).

It would be the most comfortably for users and buyers to use conventional both the bicycle and the floatation member under theirs ordinary experience, so that movement and steering might be carried out directly by a tires.

OBJECTS AND ADVANTAGES

Accordingly, several objects and advantages of the present invention are:

(a) to provide a possibility for movement over the water on the conventional bicycle installed on the conventional floatation member without any modification of both the bicycle and the member;

(b) to provide a operating conditions of this structure are comfortably and under ordinary experience for users both the bicycle and the member;

(c) to provide this structure is easily mounted and given a working condition;

(d) to provide this structure with a minimum of mass and overall dimensions (when is folding);

(e) to provide a minimum of the production costs of this structure.

This is setting a goal been reached so that the conventional bicycle is installed on the conventional sail board. The board is provided with two side pontoons, propellers and steering elements. The propellers are kinematically connected to supporting rollers with the tire of the bicycle rear wheel, but the steering elements are kinematically connected to support with the tire of the bicycle front wheel so that any model of board can be joined with any model of bicycle regardless of its size and wheelbase. All of these members are combined of the common module.

DRAWING FIGURES

FIG. 1 shows a front view of the bike-board.

Figure 2:
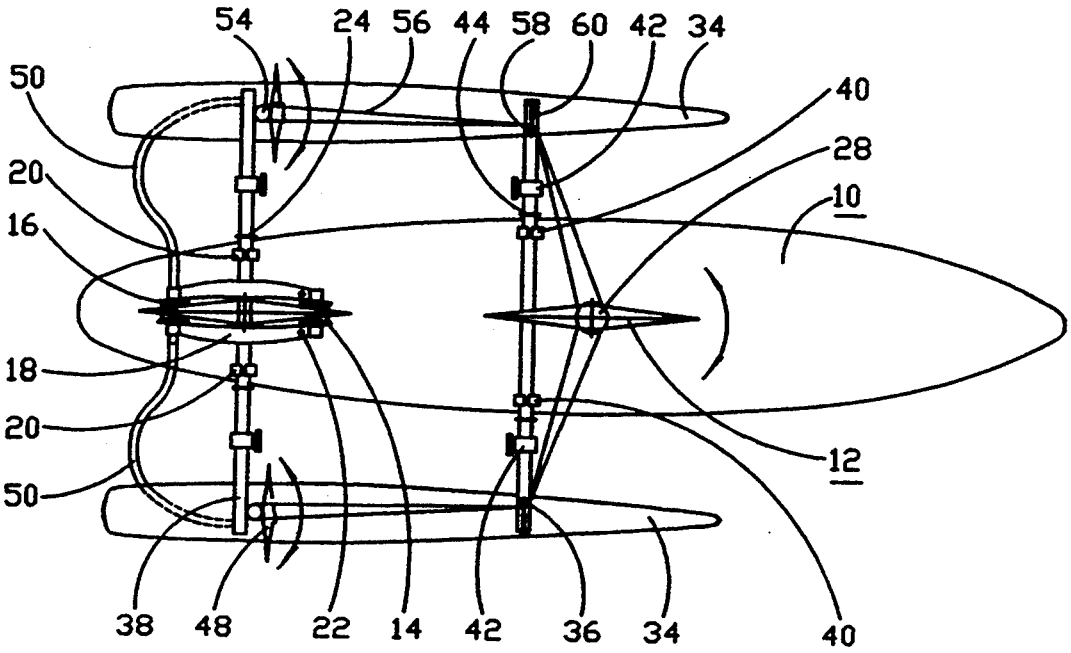

FIG. 2 shown a top view of the bike-board.

Figure 3:
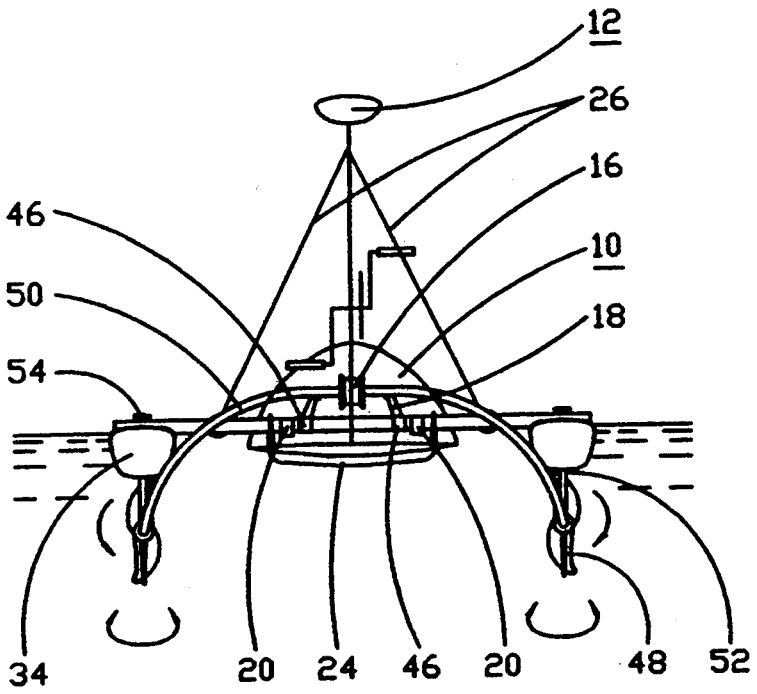

FIG. 3 shown a left-side view of the bike-board.

Figure 4:
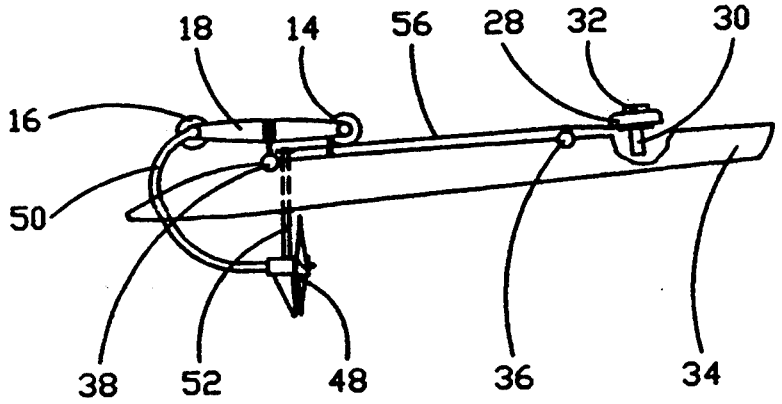

FIG. 4 shown a front view of the module (without the bicycle and the board).

Figure 5:
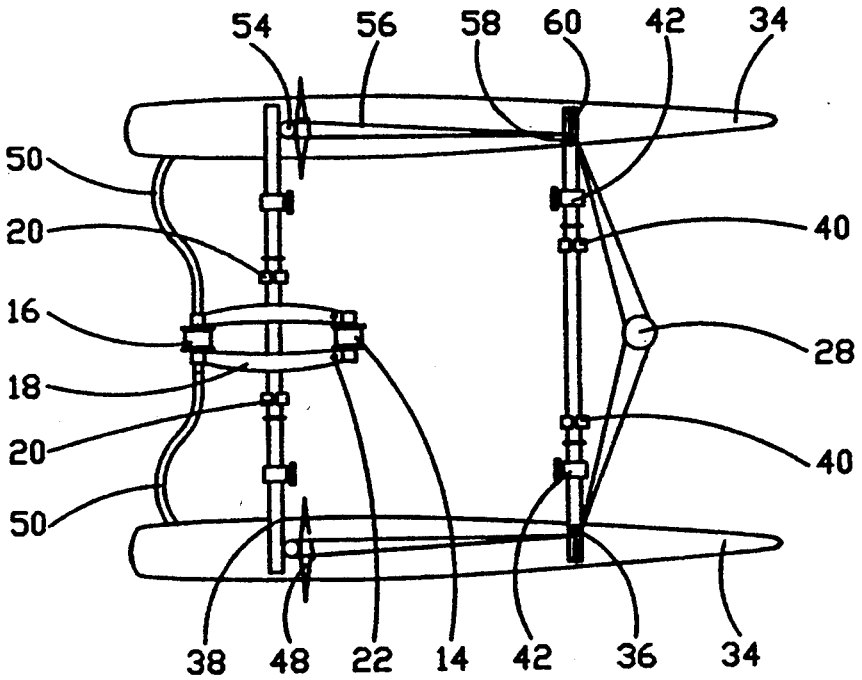

FIG. 5 shown a top view of the module (without the bicycle and the board).

Figure 6:
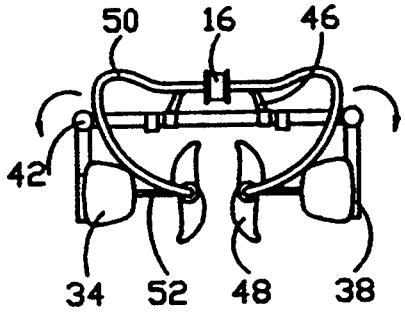

FIG. 6 shown a left-side view of the module when is folding.

Figure 7:
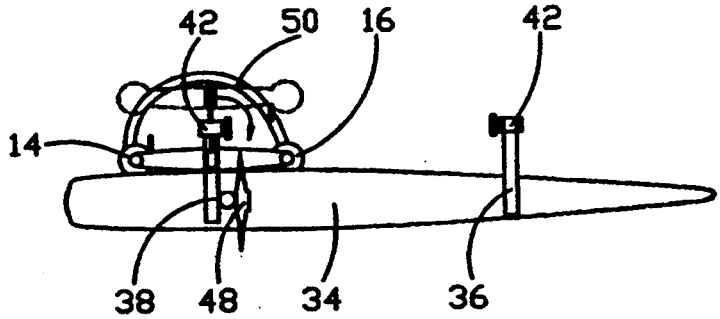

FIG. 7 shown a front view of the module when is folding.

REFERENCE NUMBERS IN DRAWING

| | | |
|---|---|---|
| 10 board | 28 support | 46 bushing |
| 12 bicycle | 30 pin | 48 propeller |
| 14 roller | 32 clamp | 50 flexible shaft |
| 16 roller | 34 pontoon | 52 pivot shaft |
| 18 frame | 36 beam | 54 quadrant |
| 20 leg | 38 beam | 56 steering cable |
| 22 leg | 40 leg | 58 block |
| 24 strap | 42 hinge | 60 turnbuckle |
| 26 strap | 44 strap | |

DESCRIPTION OF INVENTION

Referring to FIG. 1, there shown a conventional bicycle 12 is installed on a said board 10 so that the bicycle rear wheel is mounted on a pair of rollers 14 and 16. Front roller 14 is supporting but rear roller 16 is driving. Both rollers 14 and 16 are mounted on a common frame 18 which is provided with three supporting legs 20—two and 22—one (FIG. 2). Legs 20 and 22 are disposed in a shape of a isosceles triangle (FIG. 2) so that one leg 22 (front) is at vertex of triangle and two legs 20 (rear) are at base of triangle. Legs 20 are disposed symmetrical to center line of board. Frame 18 is mounted on the upper surface of board 10 by legs 20 and 22 and is pressed to it with the help of a strap 24 (FIG. 3) surrounded board 10 from below. Bicycle 12 is fixed by two straps 26 extending upwardly toward the top portion of the bicycle frame.

Bicycle 12 front wheel is mounted on a support 28 is made in a shape of spout. The wheel is fixed by a clamp 32. Support 28 is mounted on board 10 so it can be turned around vertical line and can be moved along center line of board 10. To achieve this support 18 is provided with a pin 30 (FIG. 4) had the shape and the dimensions exactly according to the standard safety pin of a mastfoot of a windsurf (not shown). Support 28 is inserted with pin 30 down into the mast track of board 10 which is standard too (not shown).

The stability of the bike-board is ensured by two side pontoons 34 with cross beams 36 and 38. Front beam 36 is located at the area of frame 18, but rear beam 38 is located at the area of support 28. Beam 38 is provided with a two supporting legs 40, is mounted on the upper surface of board 10 and is pressed to it with the help of a keeper 44—analogous to strap 24. Beam 36 is provided with the two supporting legs too, but these legs functionally are united with legs 20 of frame 18. To achieve this frame 18 is mounted on beam 38 with the help of bushings 46. By this the addition possibility is appeared turning frame 18 around axle of beam 38. Beam 38 is pressed to board 10 together with frame 18 with the help of the same strap 24. Beams 36 and 38 are provided with two hinges 42 each owing to which the end-parts of beams 36 and 38 can be turned in a vertical plane.

The propulsions are made in a shape of a pair propellers 48 are mounted on pontoons 34. Propellers 48 are kinematically connected to roller 16 with the help of flexible shafts 50.

For steering propellers 48 are made turning (the so-called active rudders). To achieve this propellers 48 are provided with pivot shafts 52 and quadrants 54 are connected to support 28 with the help of a steering cable 56 and blocks 58 are mounted on turnbuckles 60.

All of above said members except board 10 and bicycle 12 are combined of the module. This device is shown in FIGS. 4 and 5 (straps 26, 24 and 44 not shown).

OPERATION OF INVENTION

Said device (FIGS. 4 and 5) is mounted by its legs 20 and 40 on the board 10 and is pressed to it with the help of straps 24 and 44. Frame 18 is turned around beam 38 until leg 22 will contact to board 10. So device supported on five points: two-point locating element for front beam 36 and three-point locating element for a assembly consist of rear beam 36, frame 18 and rollers 14 and 16. This plan of setting device is propose to use any model board 10 regardless of curvature of surface board both of longitudinal and cross section.

Bicycle 12 is installed on rollers 14 and 16 and is fixed by straps 26 between of the bicycle frame and beam 38.

Support 28 is inserted with pin 30 down into the mast track of board 10, is moved and is fixed at the desired position corresponded to the wheelbase (length) of bicycle 12. This procedure is carried out analogous of setting of a windsurf mast at the desired position. Bicycle 12 front wheel is mounted on support 28 and is fixed by clamp 32. After this steering cable 56 is stretched by means of turnbuckles 60 so that when turning support 28, pivot shafts 52 can be turned easily, but without a considerable clearance.

Movement and steering bike-board on water is accomplished in the same manner as is done on land; the rider merely rotates the pedals and turns the handlebar of bicycle 12. Propellers 48 rotates from the tire of the rear wheel through roller 16 and flexible shafts 50. Steering is carried out by means turning of pivot shafts 52 (propellers 48) from the tire of the front wheel through support 28 and steering cable 56. The stability of bike-board depending on weight of the rider can be controlling by depth of pontoons 34 setting that is realized with the help of hinges 42.

Disassembling of bike-surf is done the other way. By this bike-board can be transporting (for example inside car or on a roof car) in deferent ways: (a)—the complete assembly, (b)—without bicycle 12, (c)—without bicycle 12 and board 10. In any case the minimum of the overall dimensions can be provided with the help of hinges 42 by means of pontoons 34 folding. FIGS. 6 and 7 show the transporting version without bicycle 12 and board 10. FIG. 6—the first folding stage so that pontoons 34 and end-parts of beams 36 and 38 are turned at an angle at 90° owing to hinges 42. FIG. 7—the second folding stage so that frame 18 and rollers 14 and 16 are turned at an angle at 180° owing to bushing 46.

SUMMARY, RAMIFICATIONS, AND SCOPE

Accordingly, the reader will see that the bike-board of this invention is designed so that any model of the board can be joined with any model of the bicycle without any modification of both the board and the bicycle. In addition the device for connection the board and the bicycle is designed like the common module that can be mounted easily and quickly.

Although the description above can contains many specificity's, these should not be construed as limiting the scope of the invention but as merely providing illustrations of same of the presently preferred embodiments of this invention. For example:

(a) It is possible using any type of a conventional floatation member: windsurf, ski, kayak, inflatable, etc.

(b) The propulsions can be made in a shape of propellers, paddle wheels, flippers, etc.; by this the propulsions can be mounted not only on pontoons, but on the beam, the board, etc.; number of the propulsions can be not only two (left and right), but for example one mounted on the board, etc.

(c) The pontoons can be made hard, inflatable tubes, etc.

(d) For steering the propellers can be made turning; can be used rudder; the pontoons can be turning; etc.

(e) The assembly of the rollers and its frame can be made separate from the beam.

(f) It is possible using a pair of boards with the bicycles are joined parallel. In this case the pontoons is not necessary.

(g) The rollers can be made in a shape of cylinder, can have the waist on the medium, can have flanges, can be connected with the help of a belt, etc.

( ) Etc.

Thus the scope of the invention should be determined by the appended claims and their legal equivalents, rather than by the examples given.

I claim:

1. A bike-board comprising:

(a) a bicycle, having front and rear tires, being mounted on a sailboard with a mast track;

(b) propulsion means driven by the rear tire of the bicycle by drive module means, the drive module means being in the form of a drive roller, a supporting roller which supports the rear tire, flexible shafts which are each connected at one end to the drive roller and at the other end to said propulsion means, a frame which mounts the rollers to the sailboard, a module securing straps to retain the frame on the sailboard, and a pair of bicycle securing straps to secure the bicycle to the frame;

(c) steering means driven by the front tire of the bicycle and connected to the propulsion means to steer the propulsion means, said steering means includes a support for the front tire, a pin which is adapted to fit into the holes in the mast track to allow adjustment of the bike-board for various sized bicycles, and a clamp to secure the front tire;

(d) said propulsion means being in the form of a pair of propellers;

(e) said sailboard includes a pair of stabilizing pontoons, each said pontoon supporting one of said propellers.

* * * * *